US005873198A

United States Patent [19]

DeMario

[11] Patent Number: 5,873,198

[45] Date of Patent: Feb. 23, 1999

[54] WINDOW GATE APPARATUS

[76] Inventor: Jeffrey DeMario, 45-57 162nd St., Flushing, N.Y. 11358

[21] Appl. No.: 705,809

[22] Filed: Aug. 30, 1996

Related U.S. Application Data

[63] Continuation-in-part of Ser. No. 386,156, Feb. 9, 1995, abandoned.

[51] Int. Cl.[6] ..... E05B 65/04

[52] U.S. Cl. ..... 49/67; 49/394; 292/DIG. 65

[58] Field of Search ..... 49/67, 394, 141, 49/380, 63, 61; 292/37, 156, DIG. 65, 302; 52/588.1, 585.1, 587.1

[56] References Cited

U.S. PATENT DOCUMENTS

| | | | |
|---|---|---|---|
| 4,249,345 | 2/1981 | Littleton | 49/141 X |
| 4,631,862 | 12/1986 | Gallardo | 292/302 X |
| 4,685,316 | 8/1987 | Hicks et al. | 49/141 X |
| 4,993,187 | 2/1991 | Schweiss et al. | 49/67 X |
| 5,018,302 | 5/1991 | Kluge | 49/141 X |
| 5,036,796 | 8/1991 | de May et al. | 292/302 X |
| 5,092,143 | 3/1992 | Rumbles | 49/394 X |
| 5,289,655 | 3/1994 | Marmora et al. | 49/141 |

*Primary Examiner*—Kenneth J. Dorner
*Assistant Examiner*—Jerry Redman
*Attorney, Agent, or Firm*—Malina & Wolson

[57] ABSTRACT

An apparatus for preventing unwanted entry through the windows of a structure includes an outer frame which is fastened to the structure and an inner frame which is connected to the outer frame by a pair of hinges and by a lock assembly. The lock assembly includes a locking rail which is slideably mounted in a vertical member of the inner frame and which slides downward under the influence of gravity to a normally locked position in which portions of the locking rail engage a pair of T bolts which are mounted on the outer frame and which project into the vertical member of the inner frame. The locking rail includes a pivotally mounted pin which must be moved to a vertical position to unlock the inner frame.

12 Claims, 12 Drawing Sheets

WINDOW GATE APPARATUS

This application is a continuation-in-part application of my application Ser. No. 08/386,156 filed Feb. 9, 1995 now abandoned.

BACKGROUND OF THE INVENTION

The present invention relates generally to the field of window gates for ensuring the security of a dwelling against intruders and more particularly to a window gate apparatus which combines ease of operation with security against entry from the outside.

The prior art includes numerous examples of window gates which are intended to provide increased security to a dwelling by preventing unauthorized entry into the dwelling through a window. A key requirement for such window gates is a provision for simple operation from inside the dwelling because the window gate must be capable of being operated by a variety of individuals who may range from children to the elderly and infirm. The window gate must be capable of being easily operated in normal situations as well as during extreme situations such as fires or other emergencies. In addition, the window gate must provide a high degree of security against unauthorized entry from the outside including entry by persons who have available a range of burglar tools including a variety of hooks and picks.

The window gates in the prior art are all relatively complex devices which are not capable of meeting the generally conflicting requirements of ease of operation with security against intrusion.

OBJECT AND SUMMARY OF THE INVENTION

It is an object of the present invention to provide a window gate apparatus which can be operated easily from inside a dwelling.

Another object of the present invention is to provide a window gate apparatus which is secure against unauthorized entry from outside the dwelling.

Another object of the present invention is to provide a window gate apparatus which is of relatively simple construction thereby providing reliable operation for an extended period of time.

Yet another object of the present invention is to provide a window gate apparatus which is comprised of a relatively small number of relatively simple component parts resulting in a relatively low cost of manufacture.

The foregoing and other objects and advantages of the invention will appear more clearly hereinafter.

In accordance with the present invention, there is provided a window gate apparatus which includes an outer frame which is fastened to the window frame of a dwelling or other structure and an inner frame which is connected to the outer frame by a pair of hinges and by a lock assembly which forms a key feature of the present invention.

The lock assembly includes a lock rail which is slidably mounted in a hollow vertical frame member of the inner frame. The lock rail slides downward under the influence of gravity to a normally locked position in which portions of the lock rail engage on a pair of T bolts which are mounted on the outer frame and which project into the vertical frame member.

The lower portion of the lock rail includes a pivotally mounted pin which is horizontal when the lock rail is in the locked position and which must be moved upward to a vertical position thereby moving the lockrail upward to unlock the inner frame.

The window frame apparatus includes a shield plate and an enclosure, mounted on the inner frame which prevent grasping or pulling the pin from outside the window frame thereby preventing lifting the lockrail and unlocking the window gate apparatus.

DESCRIPTION OF THE DRAWINGS

Other important advantages of the invention will be apparent from the following detailed description taken in connection with the accompanying drawings in which.

DETAILED DESCRIPTION OF THE INVENTION

Figure 1:
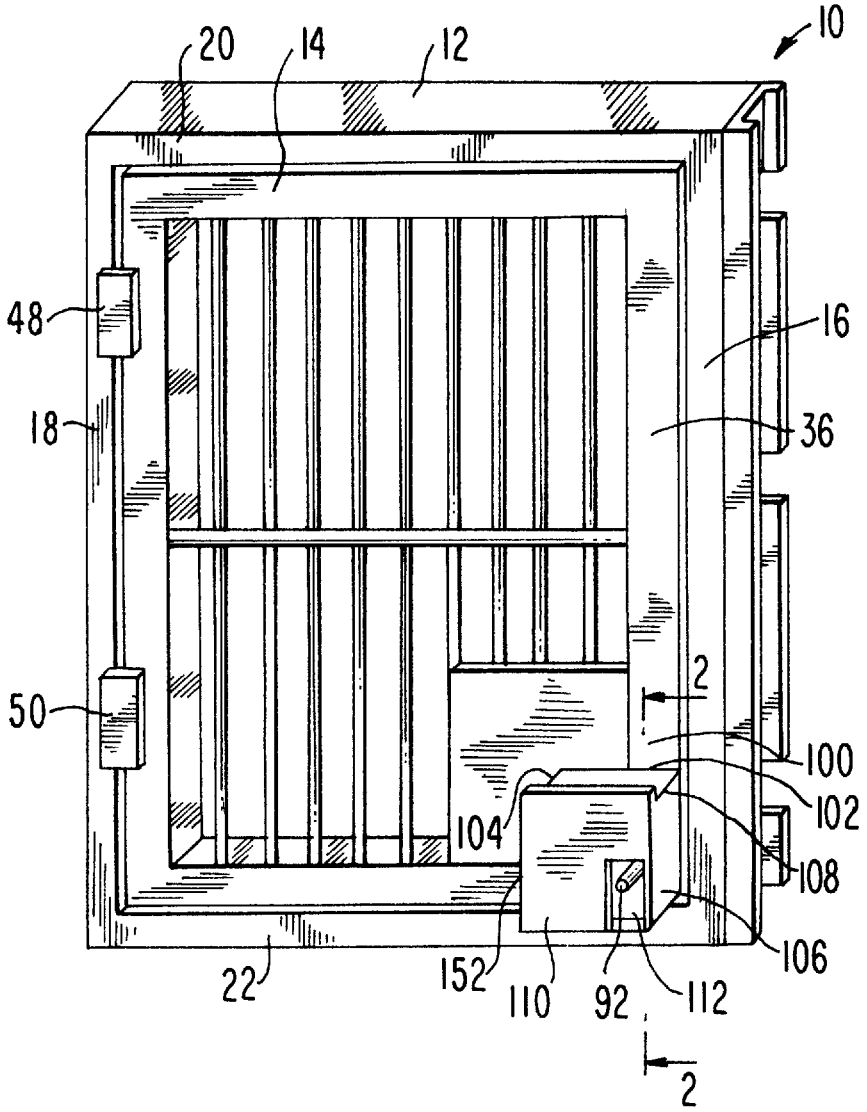
FIG. 1 is an overall perspective view of a window gate apparatus made in accordance with the present invention, with the window gate apparatus shown in the closed position as it appears from inside a dwelling.
Figure 11:
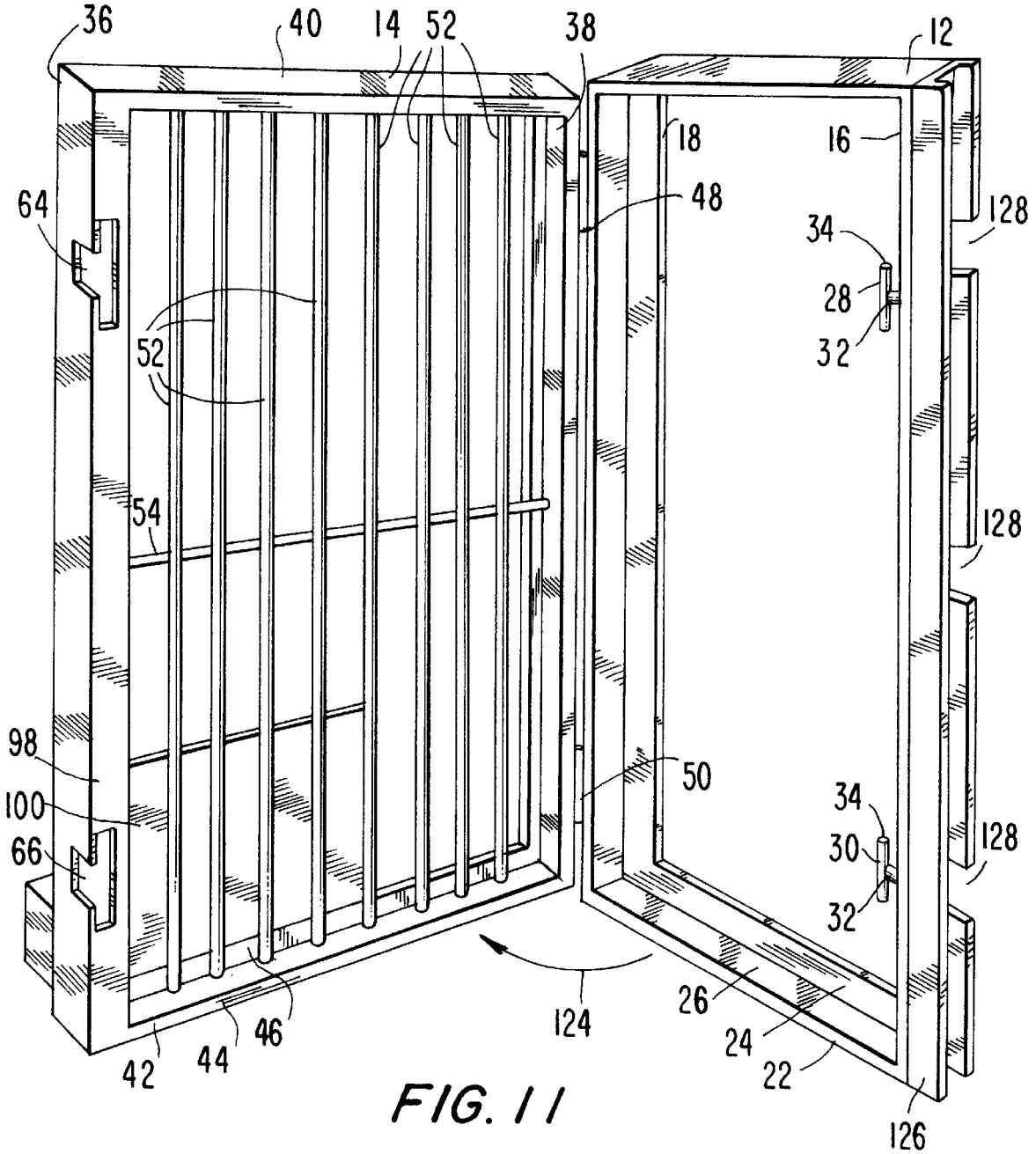
FIG. 11 is a perspective view of the window gate apparatus of FIG. 1 with the window gate apparatus shown in the open position.

With reference to the drawings there is shown in FIG. 1 a window gate apparatus 10, made in accordance with the present invention, which comprises an outer frame 12 and an inner frame 14. The outer frame 12 includes a pair of spaced apart vertical members 16,18 and a pair of spaced apart horizontal members 20,22. The horizontal members 20,22 and vertical members 16,18 are each formed as angle members each having a vertical leg and a horizontal leg indicated typically by the vertical 24 and horizontal leg 26, as shown in FIG. 11. The vertical member 16 includes a pair of T bolts 28,30 which engage and lock the outer frame 12 and the inner frame 14 in a manner which will be presently described. Each of the T bolts 28,30 has a horizontal portion 32 and a vertical portion 34.

The inner frame 14 comprises a pair of spaced apart vertical members and a pair of spaced apart horizontal members 40,42. The horizontal members 40,42 are formed as angle members each with a horizontal leg and a vertical leg as illustrated typically by the horizontal leg 44 and vertical leg 46 in FIG. 11. The vertical members 36,38 are each formed as hollow square tubular members. The vertical member 38 of the inner frame 14 is attached to the vertical member 18 of the outer frame by a pair of hinges 48,50.

The inner frame 14 includes a plurality of closely spaced vertical bars 52 and a horizontal bar 54 which form a grillwork and which cooperate to prevent entry into a dwelling or structure when the inner frame 14 is in the closed and locked position as is shown in FIG. 1.

Figure 2:
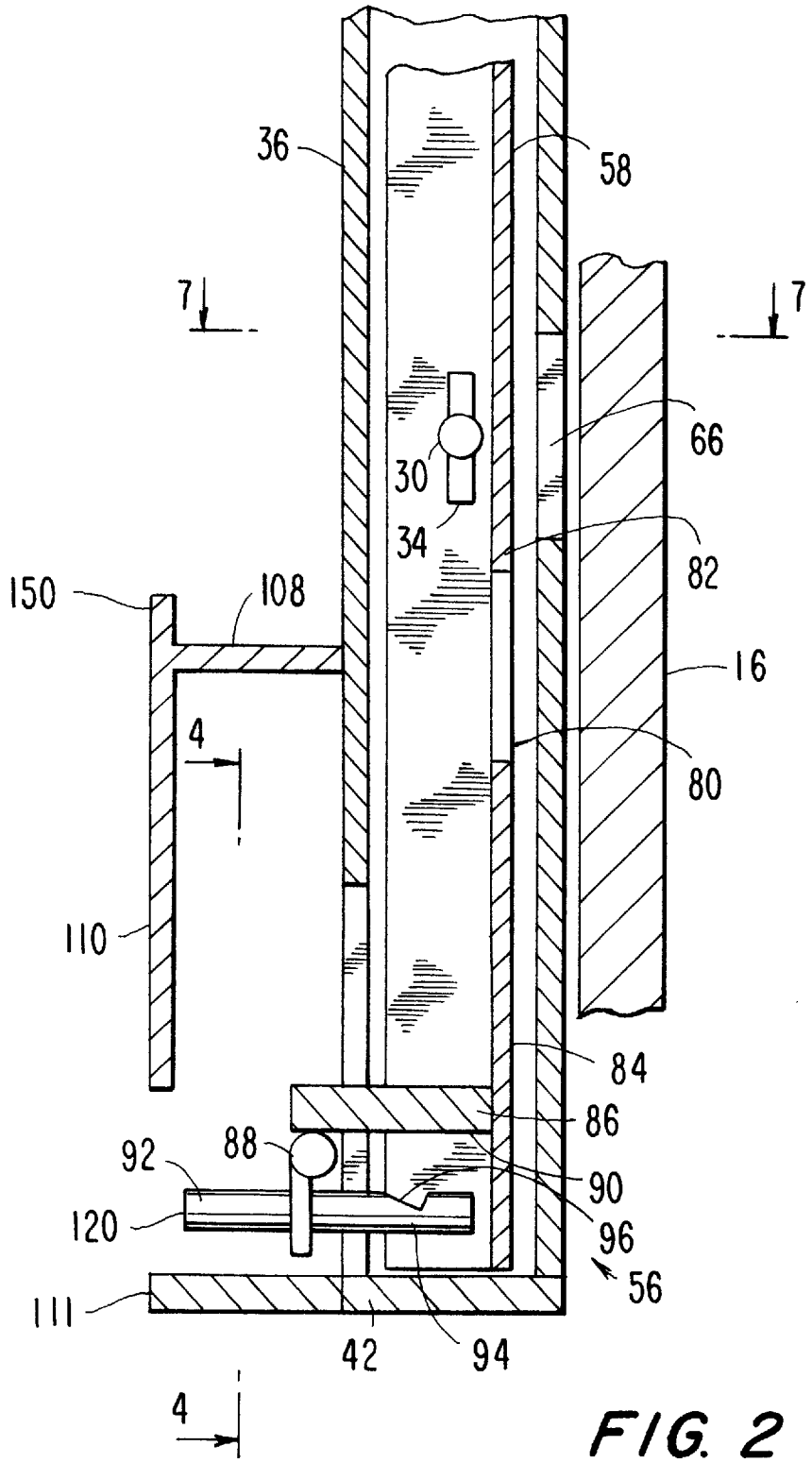
FIG. 2 is a cross-sectional view taken along the line 2—2 of FIG. 1 with the window gate apparatus shown in the locked position.
Figure 3:
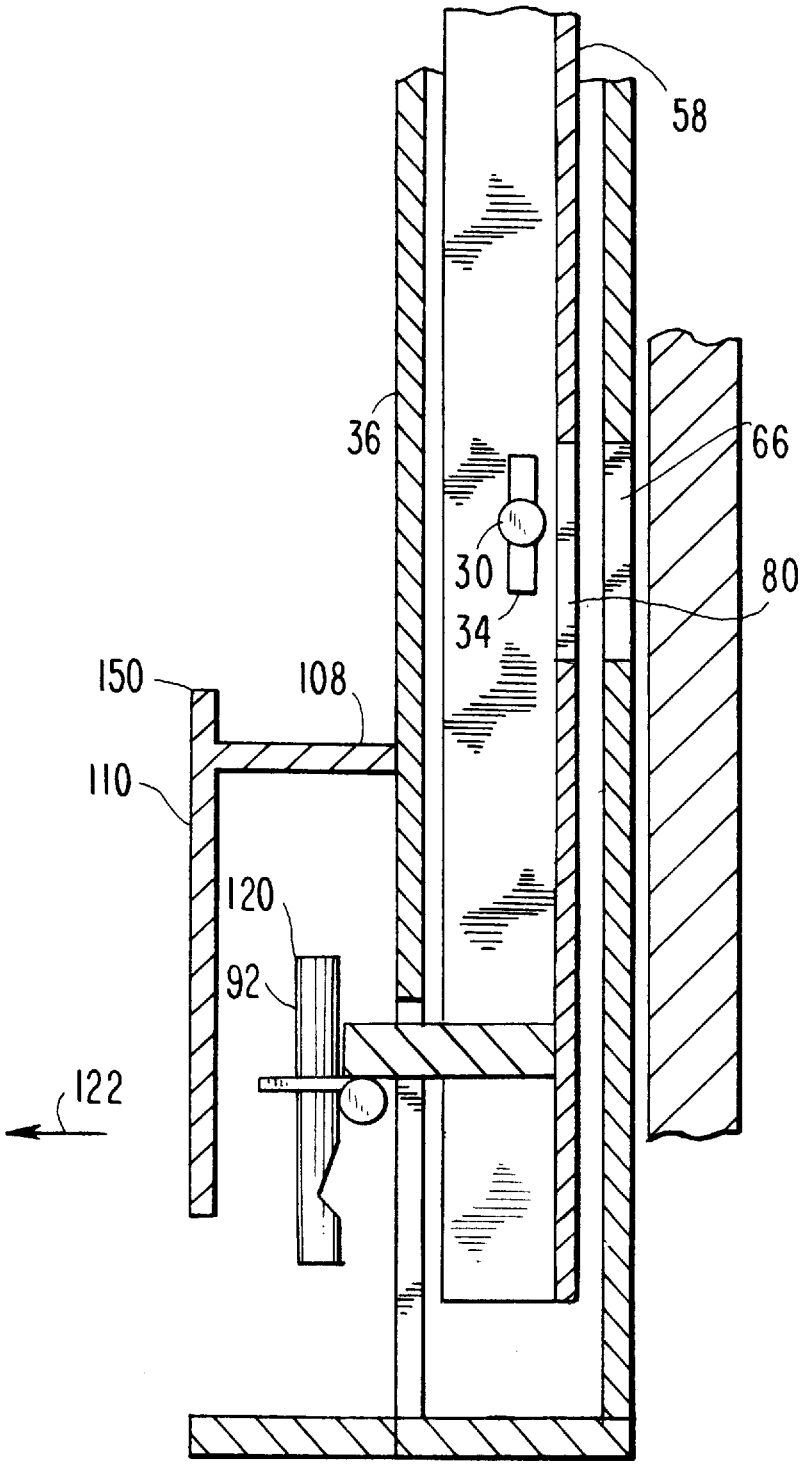
FIG. 3 is a cross-sectional view similar to FIG. 2 with the window gate apparatus shown in the unlocked position.
Figure 4:
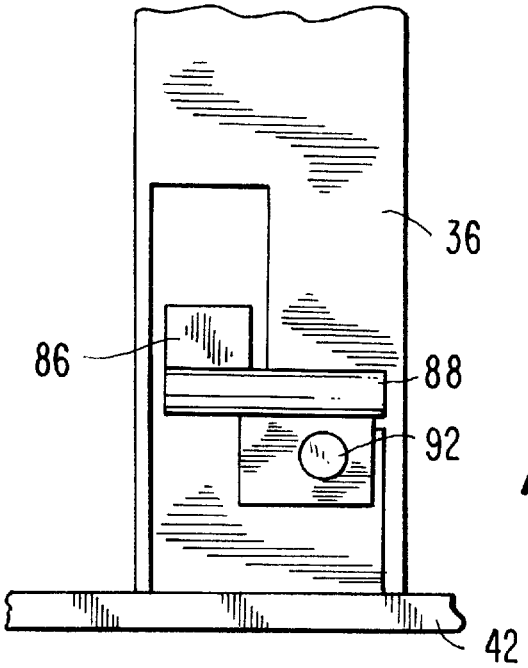
FIG. 4 is a fragmentary elevation view taken along the line 4—4 of FIG. 2.
Figure 7:
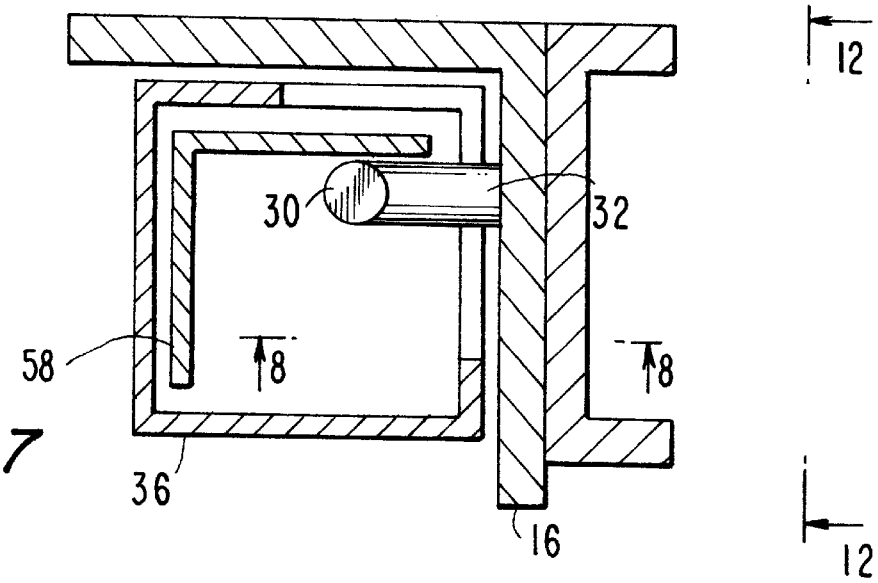
FIG. 7 is a cross-sectional view taken along the line 7—7 of FIG. 2.
Figure 8:
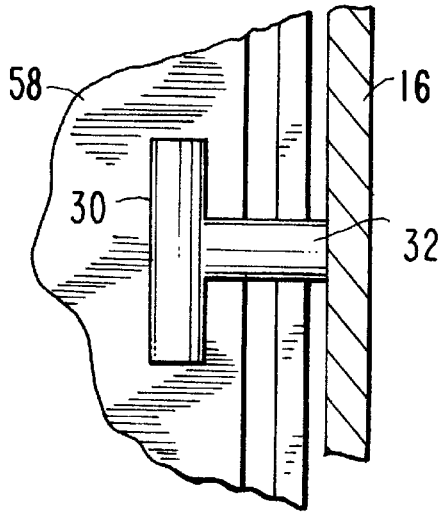
FIG. 8 is a cross-sectional view taken along the line 8—8 of FIG. 7.

The lock assembly 56 which locks the inner frame 14 is best shown in FIGS. 2 and 3. The lock assembly 56 includes a locking rail 58 which is slidably mounted in tubular vertical member 36 of the inner frame 14 as is shown in FIG. 2. The walls 60,62 of the vertical member 36 include a pair of T shaped apertures 72,74 are each generally centered relative to the apertures 68,70 and the apertures 68,72 and the apertures 70,74 together form the generally T shaped apertures 64,66. The apertures 64,66 are proportioned to accept the T bolts 28,30 which are mounted on the vertical member 16 and which project into the tubular member 36 as is shown in FIGS. 2,3 and 7.

Figure 10:
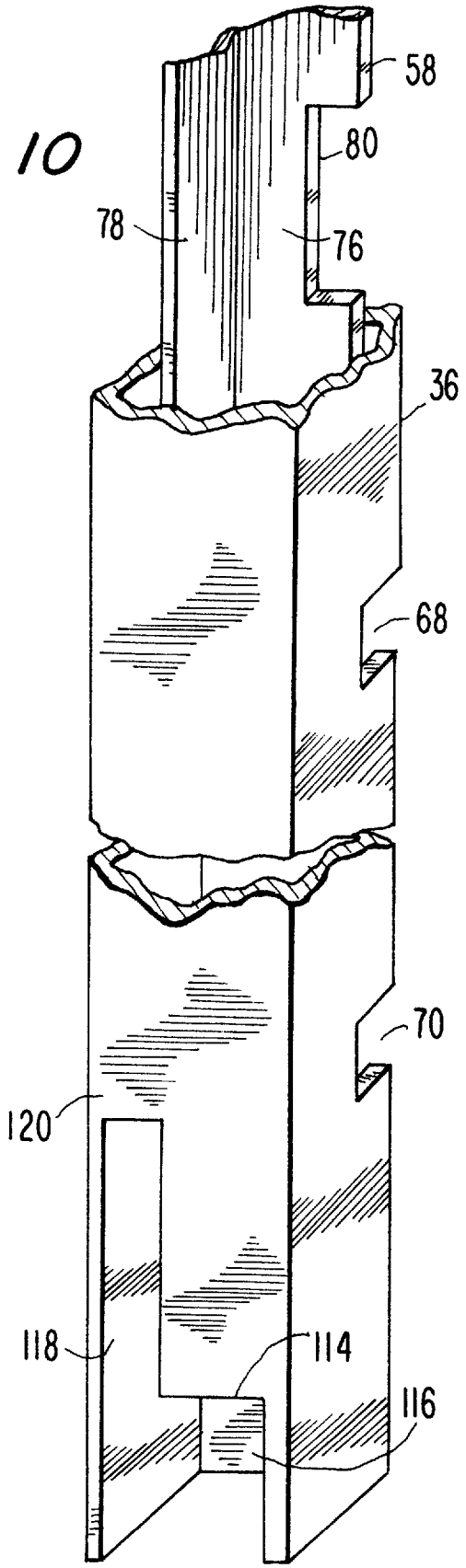
FIG. 10 is a perspective view of the end frame member similar to FIG. 9, with a portion of the end frame member shown broken away to show details of construction of the locking rail.

The locking rail 58 includes a pair of legs 76,78 which are generally mutually perpendicular. The leg 76 includes a pair of identical apertures 80 one of which is shown in FIG. 10. The aperture 80 is proportioned to accept the T bolt 28 and to allow the projection of the T bolt 28 into the vertical member 36 when the apertures 80 in the locking rail 58 are in alignment with the apertures 64,66 in the vertical member 36. When the locking rail 58 is allowed to move downward under the influence of gravity to a lower position as shown in FIG. 2, the apertures 80 in the locking rail are displaced from the apertures 64,66 in the vertical member 36 as is shown, for example, in FIG. 2, the aperture 80 is displaced from the aperture 66. When the locking rail 58 is in the lower or locked position shown in FIG. 2, the portion 82 of the locking rail 58 prevents the T bolt 30 from passing through the aperture 66 and thereby locks the inner frame 14 and the outer frame 12.

The lower portion 84 of the locking rail 58 includes a projecting bracket member 86. A hinge member 88, which is attached to a lower surface 90 of the bracket member 86, is attached to a pin member 92. The hinge member 88 enables the pin member 92 to pivot relative to the locking rail 58 in a manner which will be presently described. The intermediate portion 94 of the pin member 92 includes a recess 96 or hook portion.

The lower portion 98 of the inner frame 14 includes a shield plate 100 and an enclosure 102. The enclosure 102 includes a pair of side walls 104,106 a top wall 108, a front wall 110 and a bottom wall 111. The front wall 110 includes an aperture 112 which is in general alignment with the pin member 92 and which allows access to the pin member 92 from inside the dwelling.

Figure 5:
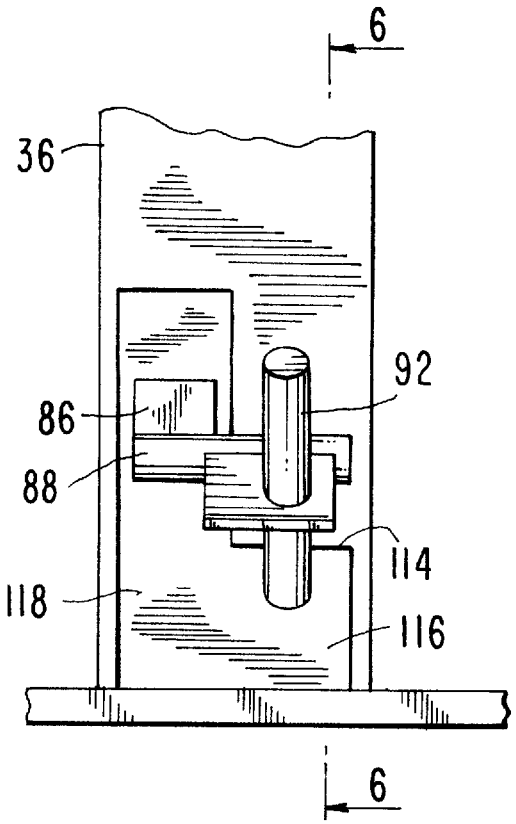
FIG. 5 is a view similar to FIG. 4 showing the window gate apparatus in the process of being opened.
Figure 6:
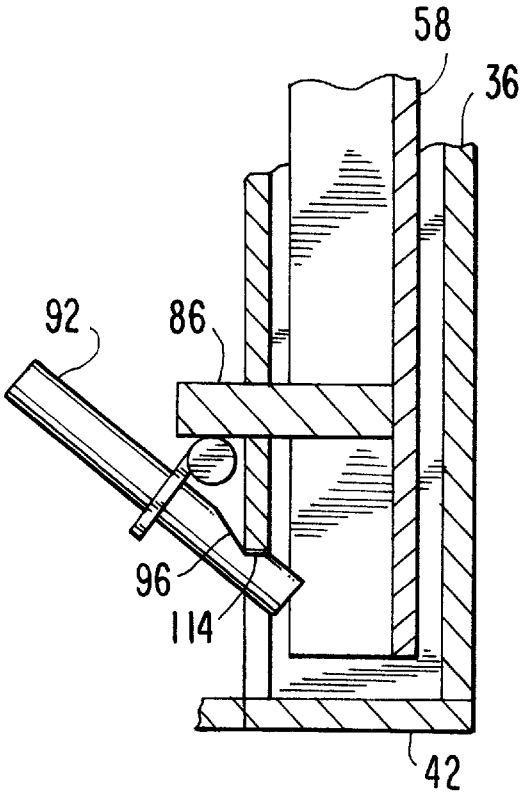
FIG. 6 is a cross-sectional view taken along the 6—6 of FIG. 5.

The shield plate 100 and the enclosure 102 prevent access to the pin member 92 from outside the dwelling. If an intruder attempts to open the window gate apparatus 10 using a hook or other tool to grasp and lift the pin member 92, the hinge 86 will allow the pin member 92 to pivot thereby rendering the hook useless. In addition, the front wall 110 of the enclosure 102 will prevent the lifting of the pin member 92. The recess 96 on the pin member 92 acts as an additional safety device. As is shown in FIGS. 5 and 6, if the pin member 92 is lifted by an intruder with the pin member 92 in an inclined position, rather than vertical, the recess 96 on the pin member 92 will engage the horizontal edge 114 of the vertical member 36 and vertical motion of the locking rail 58 will be prevented and the window gate apparatus 10 will remain locked.

The pivoting pin member 92 in combination with the enclosure 102, the shield plate 100 and the vertical member 36 effectively prevent unwanted entry from outside the dwelling. The horizontal edge 114 is part of a relatively shorter aperture 116 which communicates with a relatively taller aperture 118 located on the lower portion 120 of the vertical member 36 as is shown in FIG. 10.

Operation of the window gate apparatus 10 from inside the dwelling is extremely simple. The operator need only grasp the end 120 of the pin member 92 which is horizontal as is shown in FIG. 2 and move the pin member 92 in an upward direction to a vertical position as is shown in FIG. 3. Lifting the pin member 92 also lifts the locking rail 58 and brings the aperture 80 in the locking rail 58 into alignment with the T bolt 30 as is shown in FIG. 3. In this position the inner frame can be moved inwardly, in the direction indicated by the arrow 122 in FIG. 3 and the arrow 124 in FIG. 11 thereby unlocking and opening the window gate apparatus 10.

Figure 12:
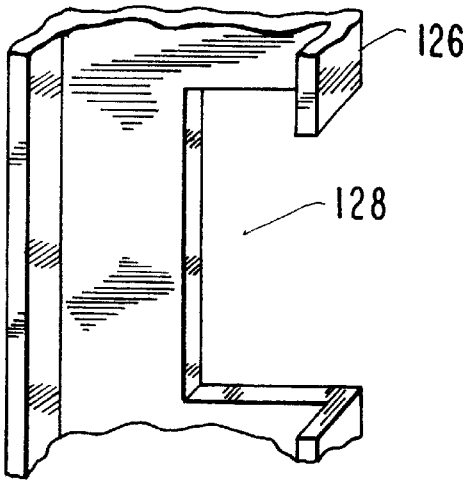
FIG. 12 is a fragmentary perspective view taken along the line 12—12 of FIG. 7.
Figure 9:
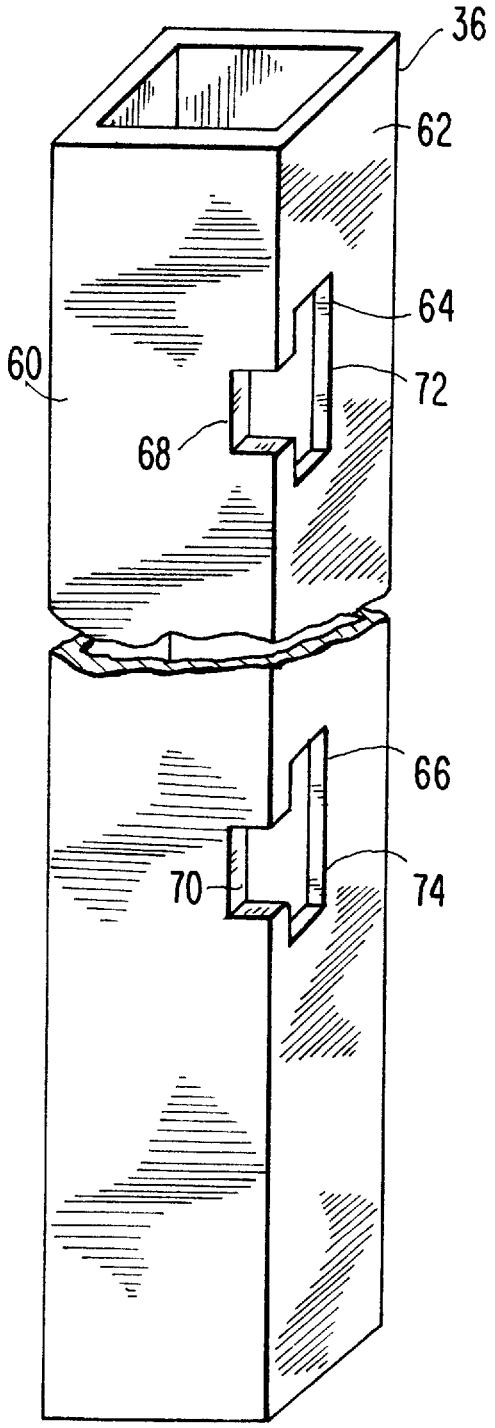
FIG. 9 is a perspective view of the end frame member of the window gate apparatus with the end frame member shown removed from the apparatus in order to show details of construction.

The window gate apparatus 10 also includes a channel member 126 which is mounted on the vertical member 16 of the outer frame 12. The channel member 126 includes three identical apertures 128 which are best illustrated in FIG. 12. The apertures 128 facilitate forced entry by Fire Department personnel in the event of an emergency.

The top edge 150 of the front wall 110 of the enclosure 102 extends above top wall 108 and the side edge 152 of the enclosure 102 extends beyond the side wall 104 as shown in FIG. 1. The edge, 150 and 152 can be used as handles to assist in opening the window gate apparatus 10. This construction eliminates the need for an unsightly handle on the inside of the window gate apparatus 10.

Figure 13:
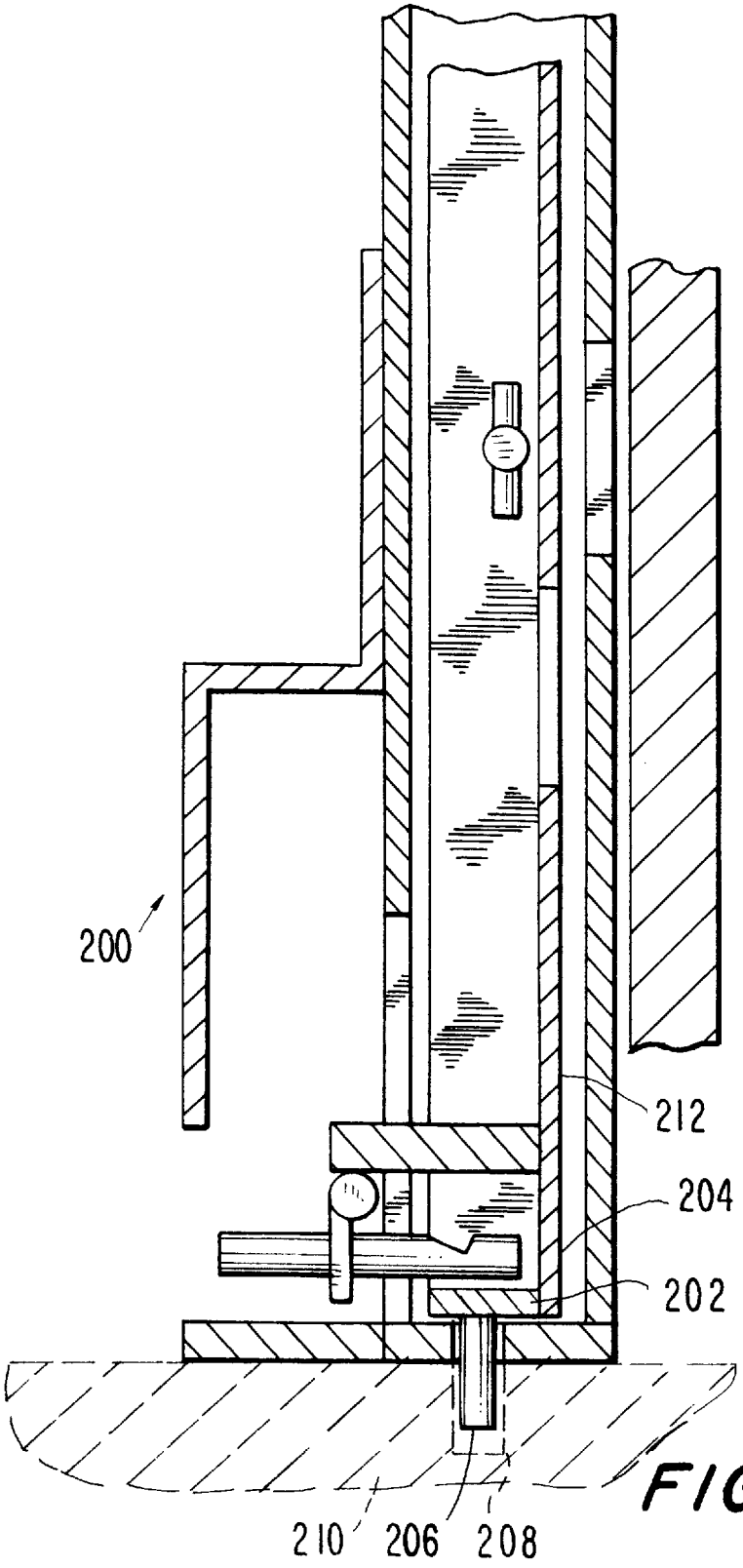
FIG. 13 is a cross-sectional view similar to FIG. 12 of an alternative embodiment of the window gate apparatus of FIG. 1 which incorporates a pin which projects into the building structure.

FIG. 13 shows an alternative embodiment of the window gate apparatus 200 which incorporates a plate 202 which is attached to the lower end 204 of the locking rail 212. A pin 206 is attached to the plate 202 and the pin 206 projects into a hole 208 in the sill portion 210 of the dwelling. The pin 206 provides an added measure of security to the window gate apparatus 200. When the locking rail 212 is lifted in order to unlock the window gate apparatus 200, in the manner which has been previously described, the pin 206 is also lifted and the window gate apparatus 200 is opened as previously described.

Figure 14:
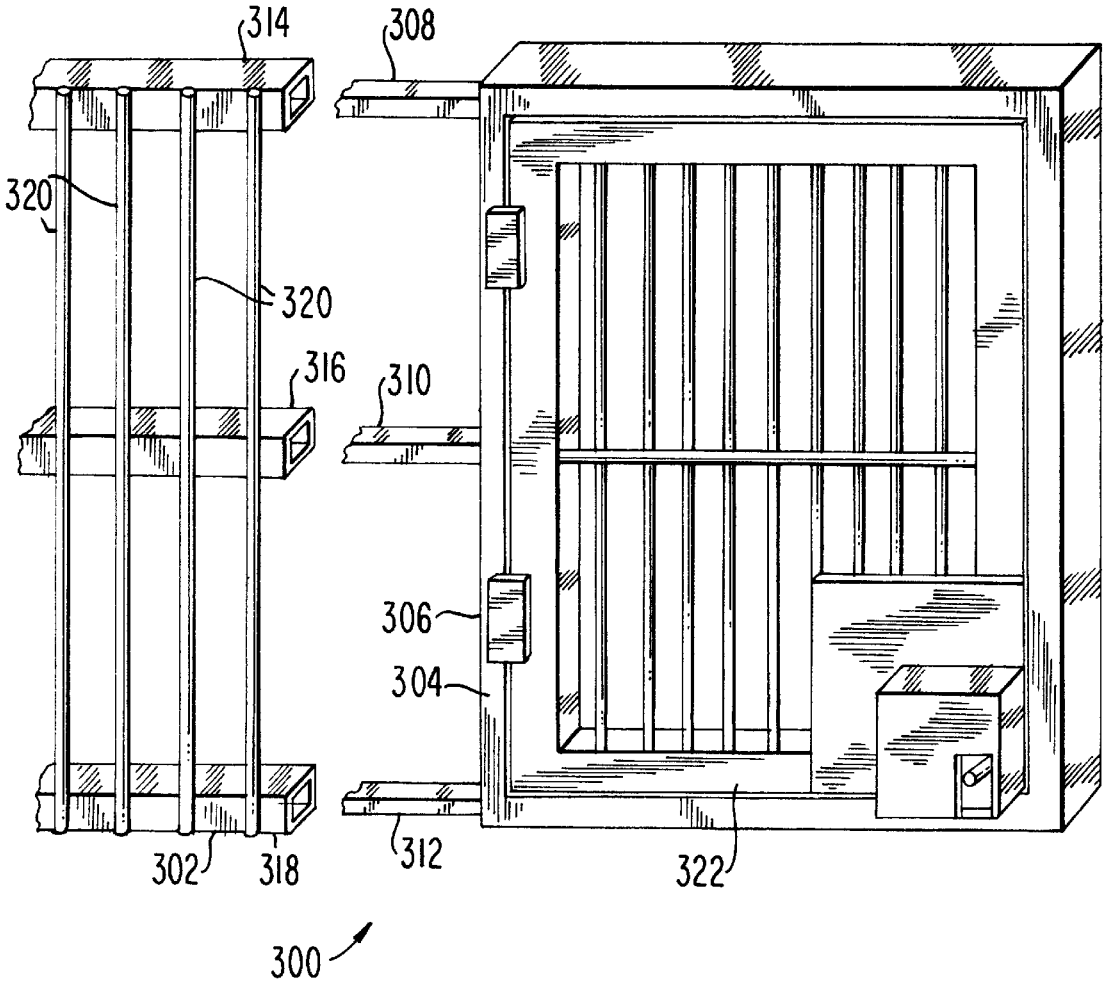
FIG. 14 is a perspective view of another alternative embodiment of the window gate apparatus of FIG. 1 which incorporates an adjustably mounted section.

FIG. 14 shows another alternative embodiment of the window gate apparatus which includes an adjustable gate portion 302. As is shown in FIG. 14, the vertical member 304 of the outer frame 306 includes three horizontal projecting members 308,310,312. When the window gate apparatus 300 is installed, the projecting members 308,310,312 project into the inside of horizontal tubular members 314, 316,318 which forms a part of the adjustable gate portion 302. The adjustable gate portion 302 also includes a plurality of vertical members 320 which are connected to the horizontal tubular members 314,316,318 and which form a grillwork to prevent unwanted entry when the window gate apparatus 300 is locked. The adjustable gate portion 302 permits the installation of the window gate apparatus 300 in windows of extended width without requiring the construction of an extremely large and heavy inner frame 322.

FIGS. 15–18 show another alternative embodiment of the window gate apparatus 400 in which the lower portion 402 of the locking rail 58 includes a projecting bracket member 404 which replaces the projecting bracket member 86, which has been previously described in connection with FIG. 2. A hinge 406 is attached to the lower surface 408 of the bracket 404. The hinge 406 includes a front leaf 410, a rear leaf 412 and a hinge pion 414. A pin member 416 is attached to the front leaf 410 and the hinge 406 enables the pin member 416 to pivot relative to the locking rail 58 in a manner which will be presently described.

The lower portion 418 of the inner frame 14 includes a shield plate 420 and an enclosure 422. The enclosure 422 includes a pair of side walls 424, 426, top wall 428, a front wall 430 and a bottom wall 432. The front wall 430 includes an aperture 434 which is in general alignment with the pin member 416 and which allows access to the pin member 416 from inside the dwelling.

The shield plate 420 and the enclosure 422 prevent access to the pin member 416 from outside the dwelling. If an intruder attempts to open the window gate apparatus 400 using a hook or other tool to grasp and lift the pin member 416, the hinge 406 will allow the pin member 406 to pivot thereby rendering this hook useless.

Figure 19:
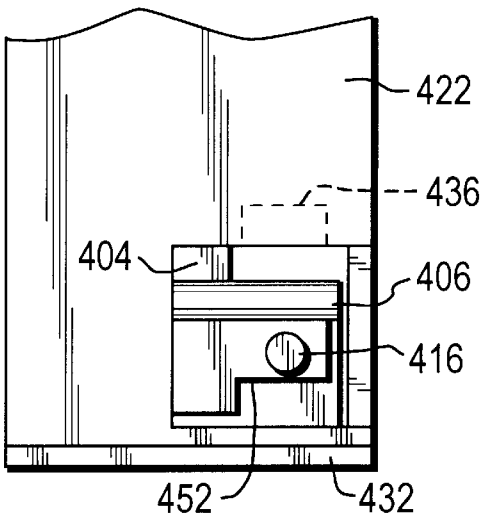
FIG. 19 is a fragmentary front elevation view taken along the line 19—19 of FIG. 16.
Figure 18:
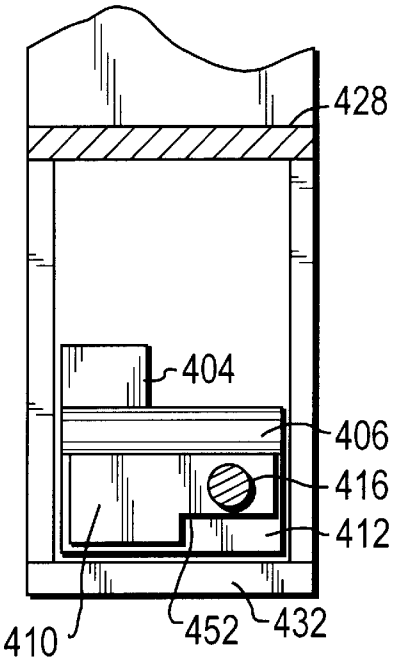
FIG. 18 is a cross-sectional view taken along the line 16—16 of FIG. 16.
Figure 15:
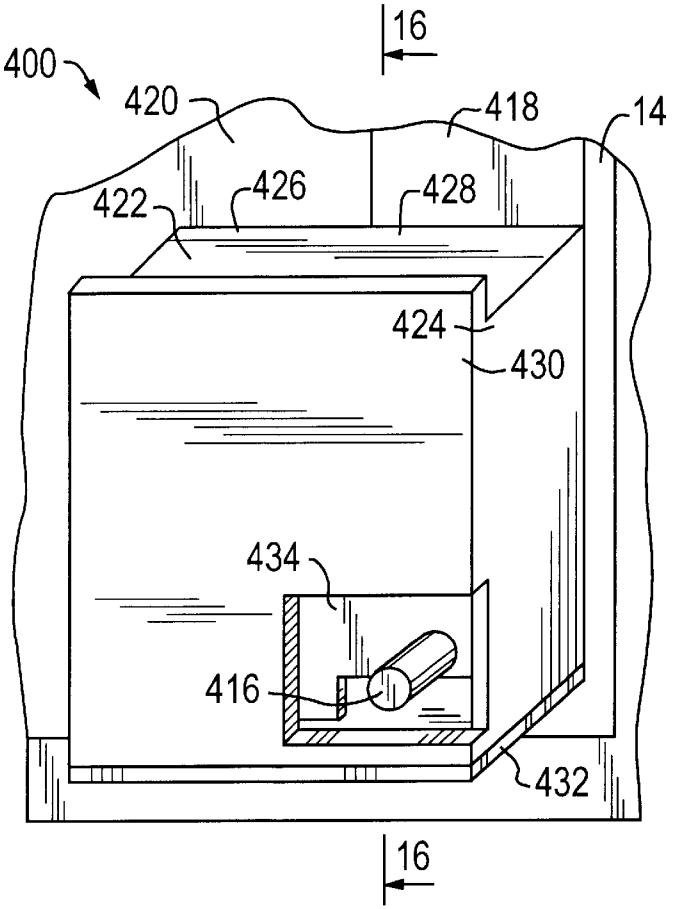
FIG. 15 is a fragmentary perspective view of yet another alternative embodiment of the window gate of FIG. 1.

The front wall 430 of the enclosure 422 includes a horizontal plate 436 which acts as an additional safety device. The plate 436 which is shown in FIGS. 16, 17 and 19 is located at the upper edge 438 of the aperture 434 in the front wall 430 and the plate 436 projects of the enclosure 422.

The lip 448 which defines the lower edge 450 of the aperture 434 provides an additional measure of security since the user must insert the fingers of his or her hand into the aperture 434 in order to move the pin member 416 to the vertical position to unlock the window gate apparatus 400. This lip 448 prevents an intruder from lifting the pin member from the outside of the dwelling using a hook or other tool inwardly toward the interior of the enclosure.

Figure 16:
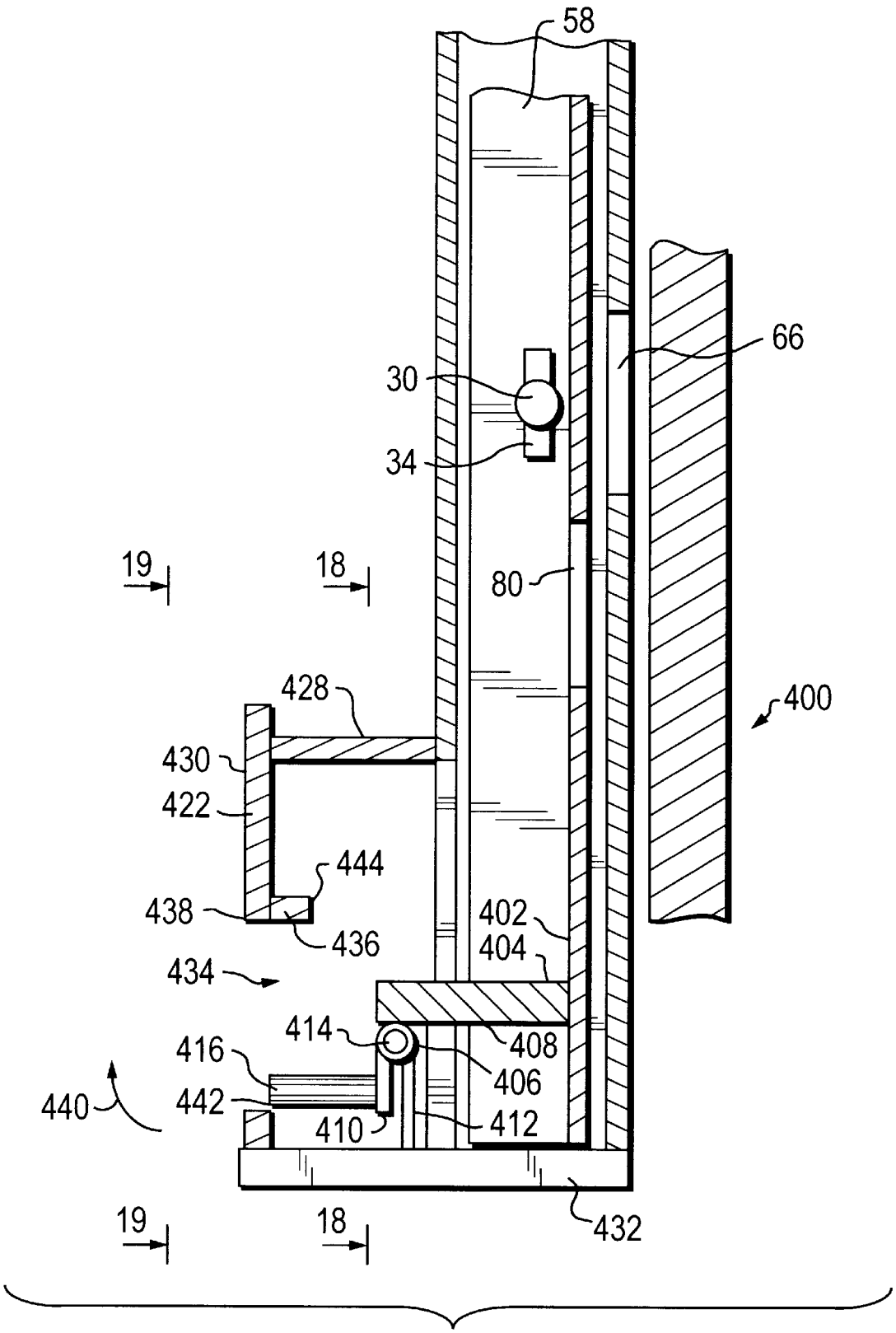
FIG. 16 is a cross-sectional view taken along the line 16—16 of FIG. 15 showing the window gate in the locked position.

The plate 436 and the pin member 416 are proportioned such that a user can reach into the enclosure 422 and move the pin member 416 in the direction shown by the arrow 440 in FIG. 16, thereby causing the end 442 of the pin member 416 to swing past the end 444 of the plate 436 to a generally vertical position. The user can then lift the locking rail 58 to the unlocked position as is shown in FIG. 17. The notch 452 formed in the front leaf 410, shown in FIGS. 18 and 19 allows the front leaf 410 to swing past the plate 436.

Figure 17:
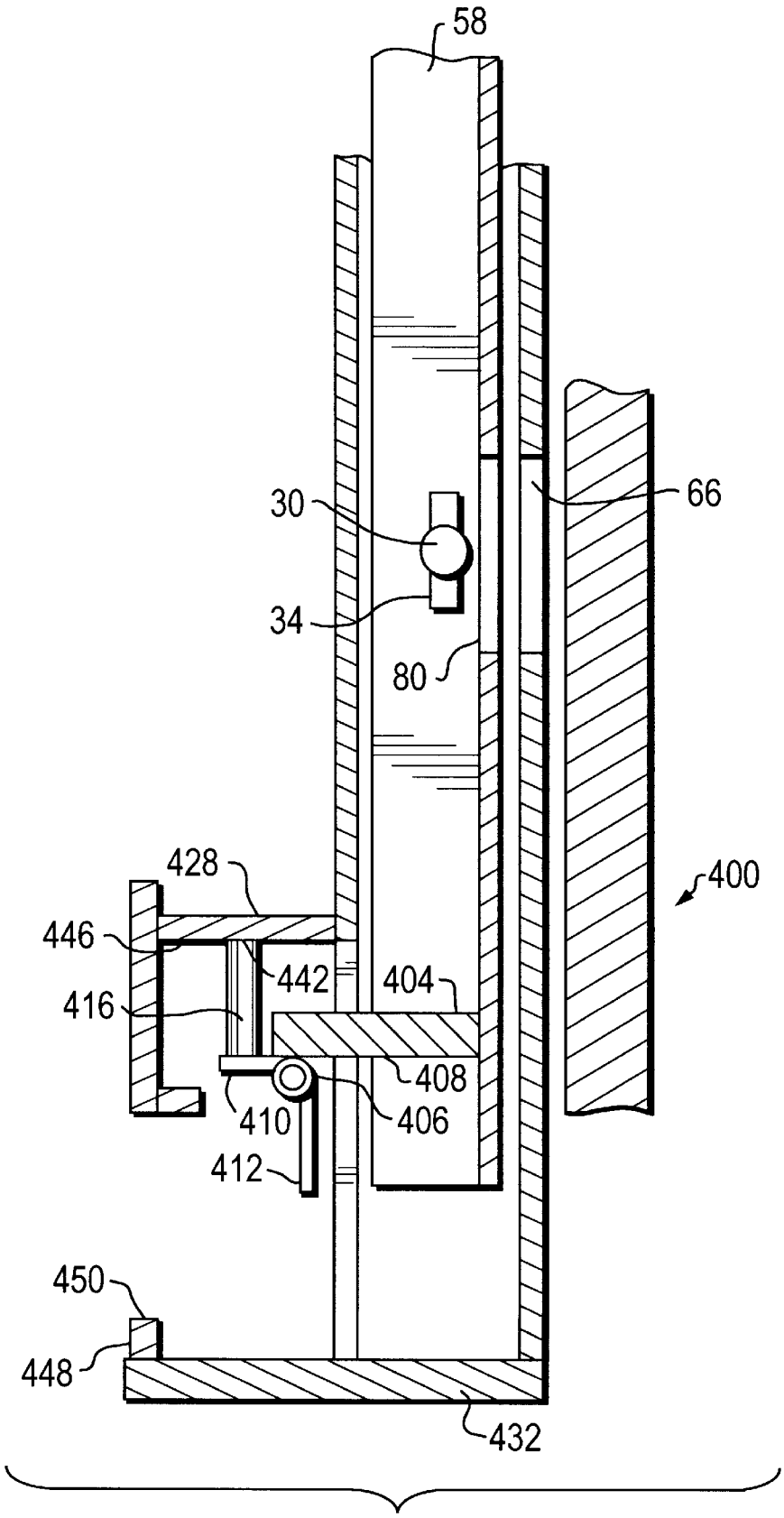
FIG. 17 is a cross-sectional view, taken along the line 16—16 of FIG. 15, similar to FIG. 16 showing the window gate in the unlocked position.

As is shown in FIG. 17 the end 442 of the pin member 416 contacts the surface 446 of the top wall 428 thereby limiting the upward travel of the locking rail 58. As is shown in FIG. 16, when the locking rail 58 is in the lower position, the rear leaf 412 of the hinge 406 contacts the bottom wall 432.

The foregoing specific embodiments of the present invention are for illustrative purposes only. Various changes and modifications may be made within the spirit and scope of the invention.

What is claimed is:

1. A window gate apparatus comprising:

outer frame means inner frame means, projecting means, mounted on said outer frame means and projecting into said inner frame means, hinged connection means connecting said outer and said inner frame means, locking means reversibly locking said outer and said inner frame means with said locking means comprising, a sliding locking rail with said sliding locking rail slidably mounted on said inner frame means and capable of a lower position engaging said projecting means and locking said inner frame to said outer frame and an upper unlocked position, with said locking rail having an upper end and a lower end, a pin member with said pin member pivotally mounted on said lower end of said locking rail and engages said inner frame means, barrier means mounted on said inner frame means, with said barrier means preventing entry through said window gate apparatus when said inner frame means is locked to said outer frame means.

2. A window gate apparatus according to claim 1 in which said projecting means comprises a T bolt.

3. A window gate apparatus according to claim 2 in which said inner frame means comprises a hollow member with said projecting means projecting into said hollow member.

4. A window gate apparatus according to claim 3 in which said locking rail is slidably mounted in said hollow member.

5. A window gate apparatus according to claim 1 in which said inner frame means further comprises a shield plate and an enclosure with said shield plate and said enclosure disposed proximate to said pin.

6. A window gate apparatus according to claim 5, in which said enclosure further comprises an aperture portion with said aperture portion in general alignment with said pin.

7. A window gate according to claim 6 in which said enclosure further comprises a front wall, with said front wall defining said aperture;

plate means, with said plate means disposed on said front wall and projecting inwardly relative to said enclosure.

8. A window gate according to claim 7 in which said plate means disposed on said front wall of said enclosure contacts said pin and prevents lifting of said sliding locking rail to said upper unlocked position unless said pin member is in said generally vertical position.

9. A window gate according to claim 5 in which said enclosure comprises an upper wall and in which said pin member is capable of a generally horizontal position and a generally vertical position, with said pin member having an end portion and with said end portion of said pin member contacting said top wall of said enclosure when said pin member is in said generally vertical position and said sliding locking rail is in said upper unlocked position.

10. A window gate apparatus according to claim 1 with said outer frame means further comprising an adjustably mounted grillwork panel.

11. A window gate apparatus according to claim 1 in which said lower end of said locking rail further comprises a pin member with said pin member mounted on said locking rail and projecting in general alignment with said locking rail.

12. A window gate according to claim 1 further comprising a hinge member mounted on said lower end of said locking rail and with said pin member mounted on said hinge member.

* * * * *